US006778049B1

(12) United States Patent
Alyanak

(10) Patent No.: US 6,778,049 B1
(45) Date of Patent: Aug. 17, 2004

(54) APPARATUS AND METHOD FOR CHANGING THE DYNAMIC RESPONSE OF AN ELECTROMAGNETICALLY OPERATED ACTUATOR

(75) Inventor: Mehmet Zeki Alyanak, Yorktown, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/410,584

(22) Filed: Oct. 1, 1999

(51) Int. Cl.[7] ..... H01F 3/00; H01F 7/08

(52) U.S. Cl. ..... 335/255; 335/261; 335/262; 335/270; 335/274; 335/279

(58) Field of Search ..... 335/255, 261–263, 335/270–274, 277, 279

(56) References Cited

U.S. PATENT DOCUMENTS

| | | | | |
|---|---|---|---|---|
| 2,419,333 A | | 4/1947 | Christiansen | 175/341 |
| 4,044,324 A | | 8/1977 | Coors | 335/260 |
| 4,131,866 A | | 12/1978 | Torr | 335/262 |
| 4,390,158 A | | 6/1983 | Lang | 251/129 |
| 4,725,039 A | | 2/1988 | Kolchinsky | 251/129.08 |
| 4,790,345 A | | 12/1988 | Kolchinsky | 137/269 |
| 4,896,127 A | * | 1/1990 | Hida | 335/239 |
| 5,005,803 A | | 4/1991 | Fritz et al. | 251/129.15 |
| 5,284,317 A | | 2/1994 | Brehm et al. | 251/129.08 |
| 5,345,050 A | | 9/1994 | Branch et al. | 200/341 |
| 5,578,978 A | * | 11/1996 | Zoerner | 335/239 |
| 5,663,700 A | * | 9/1997 | Spence et al. | 335/257 |

FOREIGN PATENT DOCUMENTS

| | | |
|---|---|---|
| DE | 1 213 925 | 11/1970 |
| DE | 0 172 591 A1 | 2/1986 |

OTHER PUBLICATIONS

Patent Abstracts of Japan JP 61–116806 (Jun. 4, 1986); Canon Inc.

* cited by examiner

*Primary Examiner*—Ramon M. Barrera

(57) ABSTRACT

An apparatus for use in components such as servo-valves, regulators and injectors for stabilizing system oscillations. The apparatus includes an armature having at least one groove formed on an exterior surface thereof; a sleeve, the armature being movably disposed in the sleeve; and a spring member disposed in the at least one groove in the armature and in sliding contact with the sleeve wherein the spring member exerts a radially outwardly directed spring force against the sleeve. A method of stabilizing an electromagnetically operated actuator comprises providing an armature having at least one groove formed on an exterior surface thereof; providing a sleeve wherein the armature is movably disposed in the sleeve; and disposing a spring member in the at least one groove in the armature and in sliding contact with the sleeve whereby the spring member exerts a radially outwardly directed spring force against the sleeve.

19 Claims, 3 Drawing Sheets

APPARATUS AND METHOD FOR CHANGING THE DYNAMIC RESPONSE OF AN ELECTROMAGNETICALLY OPERATED ACTUATOR

BACKGROUND OF THE INVENTION

The invention relates in general to electromagnetically operated actuators for controlling fluid flow and in particular to varying the dynamic response of such actuators.

Various components such as servo-valves, pressure regulators and fuel injectors may be used in both open and closed loop dynamic control systems for controlling fluid flow. It may be necessary to change the response characteristic of such components to fine tune the component within the system or to alter the overall system characteristic.

Electromagnetically operated actuators for controlling fluid flow generally include an armature disposed in a sleeve and actuated by an electric coil. The actuators control the amount of fluid flow at different pressures and are designed to operate within a certain range. Various conditions, such as high pressure and temperature, may push the limits of the actuator's operating range. Conditions such as high pressure and temperature change the operating fluid viscosity dramatically. Such changes in fluid viscosity may force the actuator to become unstable and oscillate. Thus, a need exists for an actuator which remains stable under varying conditions of pressure and temperature.

SUMMARY OF THE INVENTION

The present invention provides an apparatus comprising an armature having at least one groove formed on an exterior surface thereof; a sleeve, the armature being movably disposed in the sleeve; and a spring member disposed in the at least one groove in the armature and in sliding contact with the sleeve wherein the spring member exerts a radially outwardly directed spring force against the sleeve.

Another aspect of the invention is a method of stabilizing an electromagnetically operated actuator comprising providing an armature having at least one groove formed on an exterior surface thereof; providing a sleeve wherein the armature is movably disposed in the sleeve; and disposing a spring member in the at least one groove in the armature and in sliding contact with the sleeve whereby the spring member exerts a radially outwardly directed spring force against the sleeve.

Yet another embodiment of the invention is an apparatus comprising a sleeve having at least one groove formed on an interior surface thereof; an armature, the armature being movably disposed in the sleeve; and a spring member disposed in the at least one groove in the sleeve and in sliding contact with the armature wherein the spring member exerts a friction force against the armature.

Another aspect of the invention is an apparatus comprising an armature having at least one radial opening formed therein; a sleeve, the armature being movably disposed in the sleeve; a spring disposed in the at least one radial opening in the armature; and a bearing member disposed on one end of the spring and in sliding contact with the sleeve wherein the bearing member exerts a radially outwardly directed force against the sleeve.

Further objects, features and advantages of the invention will become apparent from the following detailed description taken in conjunction with the following drawing.

DETAILED DESCRIPTION OF THE PREFERRED EMBODIMENT

The embodiments of the invention may be used in components such as servo-valves, regulators and injectors for stabilizing system oscillations. An exemplary application is to stabilize fuel system pressure oscillations, although the embodiments may be used in other applications as well.

The embodiments of the invention include an electromagnetically operated armature. The armature is movably disposed in a sleeve. An electric coil causes the armature to move in the sleeve. At least one groove is formed on an exterior surface of the armature. A spring member is disposed in the groove. The spring member is free to expand and make contact. with the sleeve while maintaining contact with the armature. Because it is a spring, the spring member exerts a radially outwardly directed spring force against the sleeve. The spring member, therefore, constantly exerts mechanical friction between the armature and the sleeve. The mechanical friction slows the response of the armature movement and extends the stable operating range of the component in which the armature is disposed.

Figure 1:
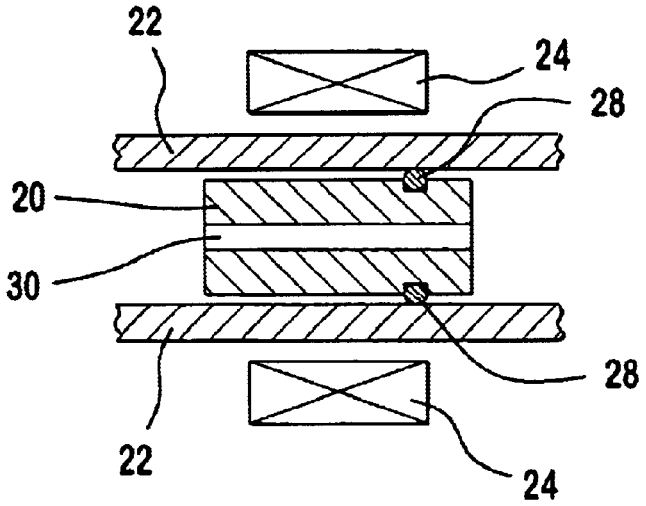
FIG. 1 is a cross-section of a first embodiment of the invention.
Figure 2:
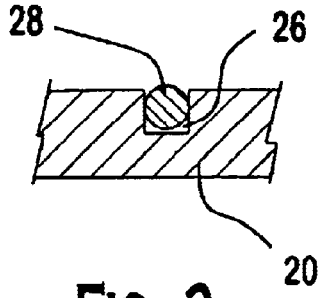
FIG. 2 shows the groove and spring member of FIG. 1 in an enlarged view.
Figure 3:
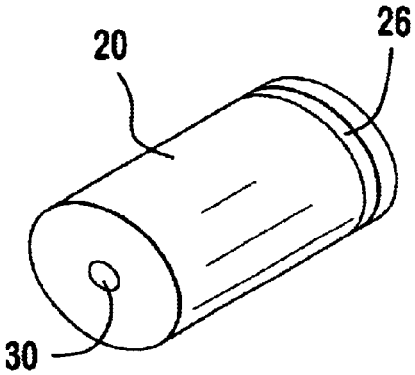
FIG. 3 is a perspective view of the armature of FIG. 1.

FIG. 1 is a cross-section of a first embodiment of the invention. FIG. 2 shows the groove and spring member of FIG. 1 in an enlarged view. FIG. 3 is a perspective view of the armature of FIG. 1.

Referring to FIGS. 1–3, an armature 20 is movably disposed in a sleeve 22. When energized, an electric coil 24 causes the armature 20 to move within the sleeve 22. The armature 20 has at least one groove 26 formed on an exterior surface thereof. A spring member 28 is disposed in the groove 26 and contacts the sleeve 22. The spring member 28 exerts a radially outwardly directed spring force against the sleeve 22. A hole 30 extends axially through the armature 20 so that fluid may flow through the armature from one side to the other. The hole 30 may be formed along the longitudinal axis of the armature or may be offset from the longitudinal axis.

Preferably, the armature 20 is generally cylindrical in shape, although other shapes of the armature are possible. The groove 26 may be formed in the armature 20 by, for example, machining, or the armature 20 may be cast with the groove 26 formed during the casting process. The groove 26 is located on the armature 20 where it will not interfere with the magnetic path.

Preferably, the groove 26 is concentric with the longitudinal axis of the armature. The groove 26 extends at least partially around the circumference of the armature and may extend completely around the armature. Likewise, the spring member 28 may extend partially around the circumference of the armature or it may extend completely around the armature. The spring member 28 also reduces wear on the armature.

The sleeve 22 and spring member 28 may be made of, for example, metal, plastic or fiber-reinforced plastic. In one embodiment, the spring member 28 is made of piano wire. Whatever the material of construction, the spring member 28 functions as more than a mere seal or bearing surface between the armature 20 and the sleeve 22. The spring member 28 functions as an active spring by exerting a radially outwardly directed spring force against the sleeve 22. The armature 20 is made of a metal.

Figure 4:
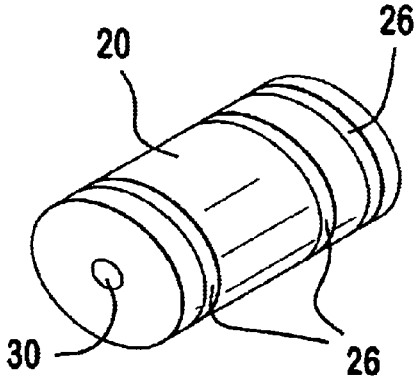
FIG. 4 is a perspective view of a second embodiment of the invention.

The amount of friction between the spring member 28 and the sleeve 22 may be varied by changing the diameter or the stiffness of the spring member 28. The amount of friction may also be changed by adding additional grooves 26 with spring members 28 disposed therein. FIG. 4 shows an armature 20 with three grooves 26 formed therein.

Figure 5:
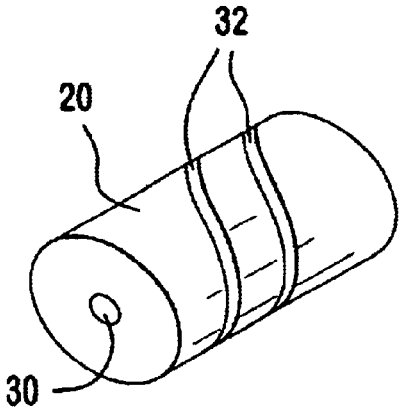
FIG. 5 is a perspective view of a third embodiment of the invention.

FIG. 5 shows an armature 20 with a helical groove 32. As in the case of the concentric grooves 26, the helical groove 32 receives a spring member 28.

Figure 6:
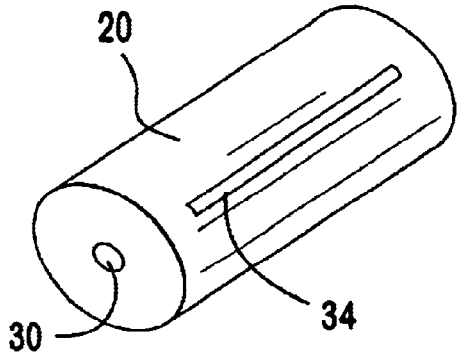
FIG. 6 is a perspective view of a fourth embodiment of the invention.
Figure 7:
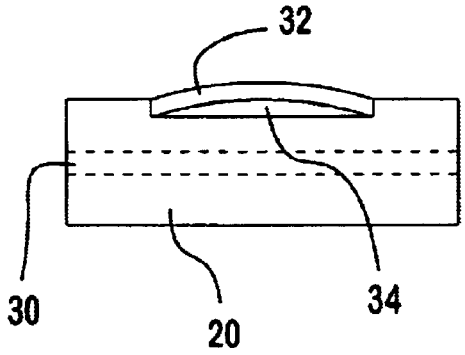
FIG. 7 is a side view of the embodiment of FIG. 6.

FIG. 6 shows an armature 20 with a groove 34 that is substantially parallel to the longitudinal axis of the armature. FIG. 7 is a side view of the armature of FIG. 6 showing a spring member 36. The spring member 36 is substantially horizontal, but is longer than the groove 34. Because the spring member 36 is longer than the groove 34, it bows upward to provide a radially outwardly directed spring force against the sleeve 22.

Figure 8:
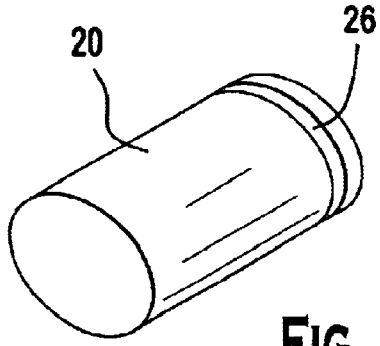
FIG. 8 is a perspective view of a fifth embodiment of the invention.
Figure 9:
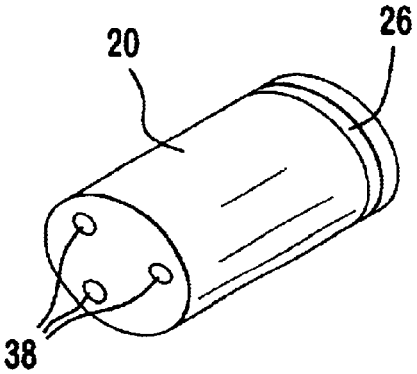
FIG. 9 is a perspective view of a sixth embodiment of the invention.

FIG. 8 shows an armature 20 with groove 26. In this embodiment, the armature 20 has no through holes. FIG. 9 shows an armature 20 with three through holes 38. The through holes 38 extend axially through the armature 20 so that fluid may flow through the armature from one side to the other. The number and placement of the through holes may be varied to suit individual operating conditions.

Figure 10:
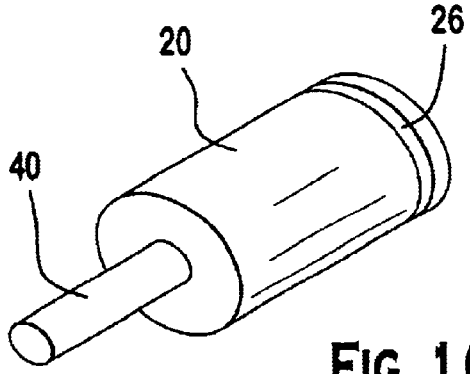
FIG. 10 is a perspective view of a seventh embodiment of the invention.

FIG. 10 is a perspective view of another embodiment of the apparatus according to the present invention. The armature 20 with groove 26 includes a plunger or valve member 40. The valve member 40 may be formed integrally with the armature 20 or may be attached to the armature by, for example, threads. The valve member 40 may close and open an orifice (not shown) in the particular pressure regulating device within which the armature is disposed. It is also possible that the armature itself, without the additional valve member 40, may function as a plunger or means for opening and closing an orifice.

Figure 11:
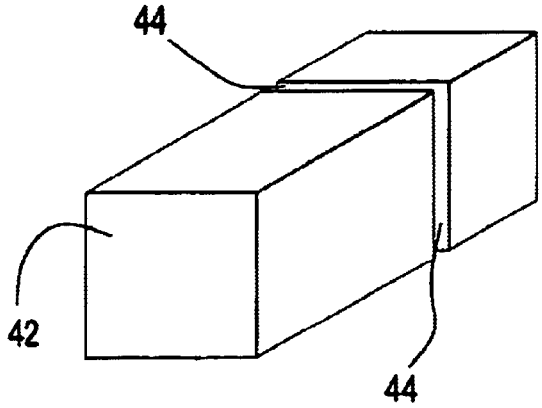
FIG. 11 is a perspective view of an eighth embodiment of the invention.
Figure 12:
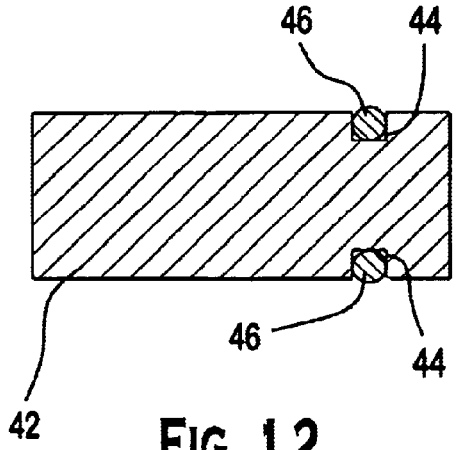
FIG. 12 is a cross-section of the embodiment of FIG. 11.

FIG. 11 is a perspective view of an eighth embodiment of the invention. FIG. 12 is a cross-section of the embodiment of FIG. 11. The armature 42 has a generally parallelepiped shape. At least one groove 44 is formed in the armature 42. A spring member 46 is disposed in the groove 44. In this embodiment, the sleeve wherein the armature 42 is disposed would also have a generally parallelepiped shape. Other shapes of the armature are also possible, such as a star shape, a triangular shape, a pentagonal shape, etc.

With reference again to FIGS. 1–3, another embodiment of the invention is a method of stabilizing an electromagnetically operated actuator. The method includes providing an armature 20 with at least one groove 26 formed therein. A spring member 28 is placed in the groove 26. The armature 20 and spring member 28 are disposed in a sleeve 22. The armature 20 may have no through holes (FIG. 8), one through hole (FIG. 1) or a plurality of through holes (FIG. 9). Because it is a spring, the spring member 28 exerts a radially outwardly directed spring force against the sleeve 22. The spring member 28 is free to expand and make contact with the sleeve 22 while maintaining contact with the armature 20. The spring member 28, therefore, constantly exerts mechanical friction between the armature 20 and the sleeve 22. The mechanical friction slows the response of the armature movement and extends the stable operating range of the component in which the armature 20 is disposed.

Figure 13:
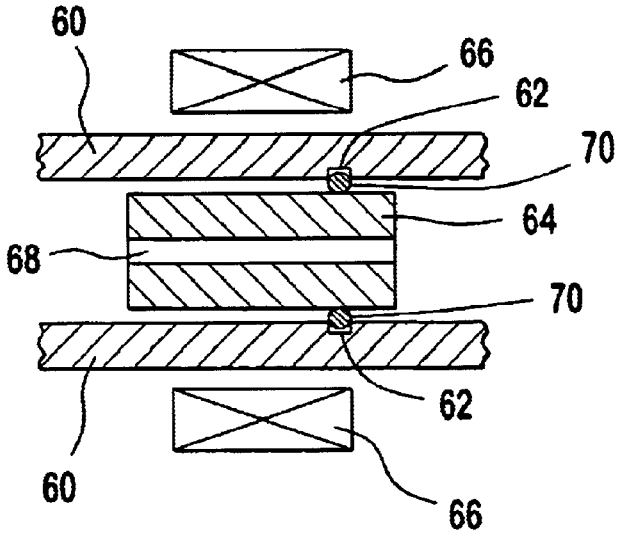
FIG. 13 is a cross-section of a ninth embodiment of the invention.
Figure 14:
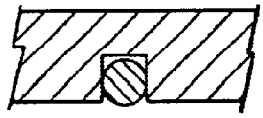
FIG. 14 shows the groove and spring member of FIG. 13 in an enlarged view.

FIG. 13 is a cross-section of a ninth embodiment of the invention. FIG. 14 shows the groove and spring member of FIG. 13 in an enlarged view.

Referring to FIGS. 13 and 14, an armature 64 is movably disposed in a sleeve 60. When energized, an electric coil 66 causes the armature 64 to move within the sleeve 60. The sleeve 60 has at least one groove 62 formed on an interior surface thereof. The groove 62 may be formed in the sleeve 60 by, for example, machining. A spring member 70 is disposed in the groove 62. The spring member 70 is maintained in place in the sleeve 60 by exerting a radially outwardly directed spring force against the groove 62 in the sleeve 60.

The inside diameter of the spring member 70 forms a friction fit with the armature 64. The dynamic response of the armature 64 may be varied by using spring members 70 with different inside diameters. By changing the inside diameter of the spring member 70, the amount of friction force on the armature 64 changes. The amount of friction may also be changed by adding additional grooves 62 with spring members 70 disposed therein.

A hole 68 extends axially through the armature 64 so that fluid may flow through the armature from one side to the other. The hole 68 may be formed along the longitudinal axis of the armature or may be offset from the longitudinal axis.

Preferably, the armature 64 is generally cylindrical in shape, although other shapes of the armature are possible. The groove 62 is located on the sleeve 60 where it will not interfere with the magnetic path. Preferably, the groove 62 is concentric with the longitudinal axis of the sleeve. The groove 62 extends at least partially around the circumference of the sleeve and may extend completely around the sleeve. Likewise, the spring member 70 may extend partially around the circumference of the sleeve or it may extend completely around the sleeve.

Figure 16:
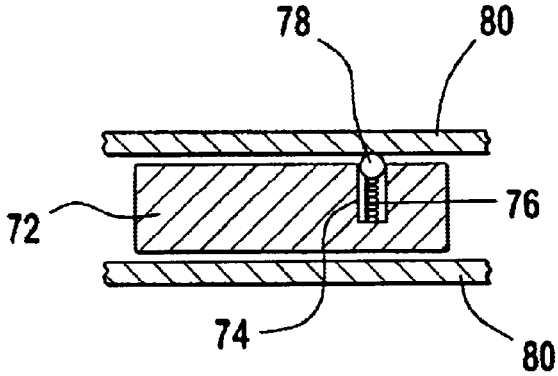
FIG. 16 is a sectional view of the embodiment of FIG. 15.
Figure 15:
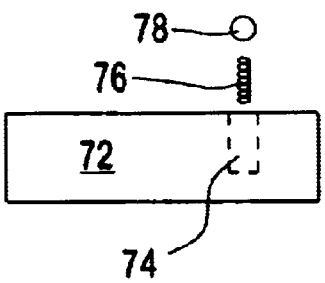
FIG. 15 is an exploded view of a tenth embodiment of the invention.

FIG. 15 is an exploded view of a tenth embodiment of the invention. FIG. 16 is a sectional view of the embodiment of FIG. 15. In the embodiment of FIGS. 15 and 16, the armature 72 includes at least one radial opening 74. The radial opening 74 may be formed by, for example, drilling the opening 74 in the armature 72. A spring 76 is inserted in the radial opening 74. One end of the spring 76 bears against the bottom of the opening 74. A bearing member 78 is located on the other end of the spring 76. The bearing member 78 may be, for example, a ball bearing.

As shown in FIG. 16, the bearing member 78 bears against the sleeve 80 because of the force of the spring member 76. The bearing member 78 creates a radially outwardly directed force against the sleeve 80. The force created by the bearing member 78 may be varied by changing the spring force of the spring member 76.

Figure 17:
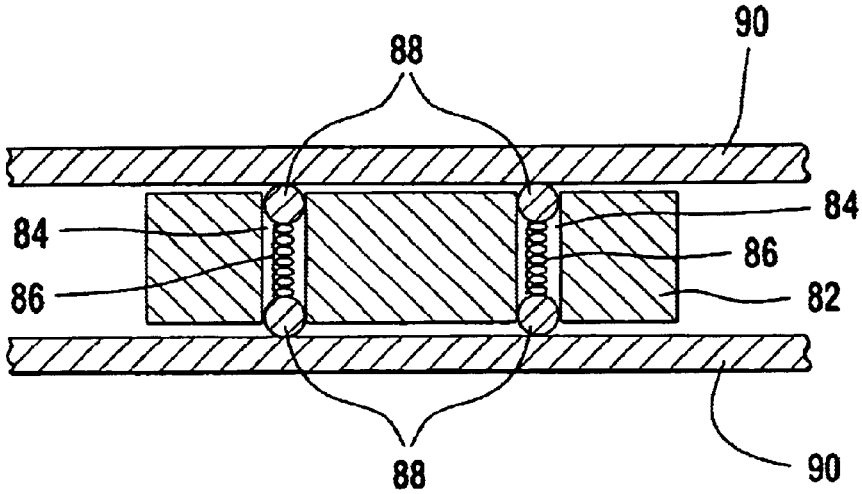
FIG. 17 is a sectional view of an eleventh embodiment of the invention.

FIG. 17 is a sectional view of an eleventh embodiment of the invention. In FIG. 17, the armature 82 includes at least one radial opening 84. The radial opening 84 extends completely through the armature 82. The radial opening 84 may be formed by, for example, drilling. A spring 86 is disposed in the radial opening 84. On each end of the spring 86 are bearing members 88, such as ball bearings. The bearing members 88 are in sliding contact with the sleeve 90.

The spring 86 forces the bearing members 88 radially outward against the sleeve thereby creating friction between the sleeve 90 and the bearing members 88. The amount of friction between the sleeve 90 and the bearing members 88 may be varied by changing the spring force of the spring 86. The friction force may also be changed by adding additional openings with springs and bearing members. FIG. 17 shows two radial openings 84 with springs 86 and bearing members 88. Only one opening 84 may be used or more than two may be used, depending on the amount of friction desired.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An apparatus, comprising:

an armature having at least one groove formed on an exterior surface thereof, the armature including a valve portion extending away from the armature;

a sleeve extending along an axis, the armature being disposed for movement in a first direction and a second direction opposite the first direction along the axis in the sleeve;

an electromagnetic coil operative to cause movement of the armature along the longitudinal axis as a response to energization of the electromagnetic coil;

a single continuous spring member disposed in the at least one groove in the armature and in direct sliding contact with the sleeve, wherein the spring member exerts a radially outwardly directed spring force against the sleeve that slows the response of the movement of the armature along the axis when the electromagnetic coil is energized.

2. The apparatus of claim 1 further comprising an electric coil disposed adjacent the sleeve for moving the armature in the sleeve.

3. The apparatus of claim 1 wherein the armature is generally cylindrical in shape.

4. The apparatus of claim 3 wherein the at least one groove is concentric with a longitudinal axis of the armature.

5. The apparatus of claim 4 wherein the armature has a plurality of grooves defined therein, the grooves being concentric with the longitudinal axis of the armature, the apparatus further comprising a plurality of spring members disposed in the plurality of grooves, respectively.

6. The apparatus of claim 1 wherein the armature defines at least one hole extending axially through the armature so that fluid may flow though the armature from one side to the other.

7. The apparatus of claim 6 wherein the armature defines a plurality of holes extending axially through the armature so that fluid may flow through the armature from one side to the other.

8. The apparatus of claim 1, wherein the valve portion is formed integrally with the armature.

9. The apparatus of claim 1, wherein the valve portion is threaded into the armature.

10. The apparatus of claim 1 wherein the armature has a generally parallelepiped shape.

11. The apparatus of claim 1 wherein the sleeve comprises a plastic material.

12. The apparatus of claim 1 wherein the sleeve comprises a metal material.

13. The apparatus of claim 1 wherein the sleeve comprises a fiber-reinforced plastic material.

14. The apparatus of claim 1 wherein the spring member comprises a plastic material.

15. The apparatus of claim 1 wherein the spring member comprises a metal material.

16. The apparatus of claim 1 wherein the spring member comprises a fiber-reinforced plastic material.

17. A method of stabilizing an electromagnetically operated actuator, comprising:

providing a coil and an armature, the armature being disposed for movement in a first direction and a second direction opposite the first direction along the axis in the sleeve, the armature having at least one groove formed on an exterior surface thereof;

moving the armature along the axis as a response to energization of the coil; and exerting a radially outwardly directed force against the sleeve by a single continuous member disposed in the at least one groove that is in direct sliding contact with the sleeve so as to slow the response of the movement of the armature along the axis when the electromagnetic coil is energized.

18. An apparatus, comprising:

an armature having a valve member extending away from the armature;

a sleeve extending along an axis, the armature being disposed for movement in a first direction and a second direction opposite the first direction along the axis in the sleeve;

an electromagnetic coil operative to cause movement of the armature along the axis as a response to energization of the electromagnetic coil; and a single continuous spring member in sliding contact with one of the armature and the sleeve, wherein the spring member creates a friction force between the sleeve and the armature that slows the response of the movement of the armature along the axis when the electromagnetic coil is energized.

19. The apparatus of claim 18 wherein the armature includes at least one groove formed on an exterior surface thereof, the spring member being disposed in the at least one groove in the armature and in sliding contact with the sleeve wherein the spring member exerts a radially outwardly directed spring force against the sleeve.

* * * * *